US010952512B2

(12) United States Patent
Cox

(10) Patent No.: US 10,952,512 B2
(45) Date of Patent: Mar. 23, 2021

(54) WEARABLE DECORATIVE BAND SYSTEMS

(71) Applicant: Amy Cox, Clifton Park, NY (US)

(72) Inventor: Amy Cox, Clifton Park, NY (US)

( * ) Notice: Subject to any disclaimer, the term of this patent is extended or adjusted under 35 U.S.C. 154(b) by 139 days.

(21) Appl. No.: 15/892,223

(22) Filed: Feb. 8, 2018

(65) Prior Publication Data

US 2018/0220753 A1 Aug. 9, 2018

Related U.S. Application Data

(60) Provisional application No. 62/456,216, filed on Feb. 8, 2017.

(51) Int. Cl.

| | |
|---|---|
| ***A44C 5/00*** | (2006.01) |
| ***A44C 5/18*** | (2006.01) |
| ***G09F 21/02*** | (2006.01) |
| ***A44C 15/00*** | (2006.01) |

(52) U.S. Cl.

CPC ..... *A44C 5/0015* (2013.01); *A44C 5/185* (2013.01); *A44C 15/003* (2013.01); *G09F 21/02* (2013.01)

(58) Field of Classification Search

CPC ..... A45C 5/0015; A45C 5/185; A45C 15/003; A45F 5/00; A45F 5/02; Y10T 24/1368; Y10T 24/1394; G09F 3/16

USPC ..... 224/219, 221, 222, 267; 40/586, 665, 40/607.14, 658

See application file for complete search history.

(56) References Cited

U.S. PATENT DOCUMENTS 3,212,690 A * 10/1965 Green ..... A41F 9/002 224/576
3,670,933 A * 6/1972 Jones ..... A44C 5/003 224/222
4,174,793 A * 11/1979 Wisowaty ..... A45C 11/32 224/240

(Continued)

FOREIGN PATENT DOCUMENTS

EP 2384662 A2 9/2011

OTHER PUBLICATIONS

"Armband for dog show", Etsy.com, Retrieved from https://www.etsy.com/in-en/listing/230723805/armband-for-dog-show-number-holder?ga_order=most_relevant&ga_search_type=all&ga_view_type=gallery&ga_search_query=dog%20show%20armband&ref=sr_gallery-1-9 on Jan. 15, 2018; 4 pages, Published on Apr. 27, 2015.

(Continued)

*Primary Examiner* — Robert Sandy
*Assistant Examiner* — Rowland Do
(74) *Attorney, Agent, or Firm* — Heslin Rothenberg Farley & Mesiti PC

(57) ABSTRACT

A decorative band system to be worn around a limb of a user includes, for example, an elongated band, a first connector, and a second connector. The elongated band includes an inner surface disposable towards the limb of the user, and an outer surface facing away. The first connector is attached to the elongated band between the first longitudinal edge and the second longitudinal edge, and releasably attachable to one or more interchangeable decorative ornamentation. The second connector is attached to the elongated band and releasably connectable to a card so that the card is spaced apart from the elongated band. The elongated band and the second connector are configured so that when the system is worn on the limb of the user and connected to the card, the (Continued)

card is maintainable in a fixed relationship alongside and parallel to the limb of the user.

27 Claims, 15 Drawing Sheets

(56) References Cited

U.S. PATENT DOCUMENTS 4,341,331 A * 7/1982 McDougall ..... A45C 1/04 224/219
4,463,482 A * 8/1984 Hawie ..... A41F 3/02 24/489
4,489,867 A 12/1984 Schwemberger
5,221,031 A * 6/1993 Prigmore ..... A45F 5/00 224/219
D358,701 S 5/1995 Gordy et al.
5,433,359 A * 7/1995 Flowers ..... A45F 5/00 224/222
5,437,399 A * 8/1995 Levitt ..... A45F 5/00 224/219
5,683,022 A * 11/1997 Evans ..... A41F 9/002 224/583
5,749,504 A * 5/1998 Bieker ..... A45F 3/00 224/221
5,752,633 A * 5/1998 Antaki ..... A45F 5/00 224/222
5,865,148 A * 2/1999 Aguirre ..... A01K 27/006 119/856
6,168,556 B1 * 1/2001 Saavedra ..... A63B 21/4019 224/220
6,422,177 B1 * 7/2002 Noguero ..... A01K 27/006 119/856
6,481,382 B2 * 11/2002 Cohn ..... A01K 27/001 119/794
6,752,305 B2 6/2004 Shattuck
7,320,318 B1 * 1/2008 Tentler ..... F41B 5/1469 124/35.2
7,743,540 B2 6/2010 McDermott
D765,945 S 9/2016 Strassburg
2003/0121127 A1 * 7/2003 Walker ..... A45D 8/36 24/306
2004/0195254 A1 * 10/2004 Bunkers ..... G09F 23/08 220/739
2005/0199715 A1 * 9/2005 Reid ..... A45F 5/02 235/384
2006/0117465 A1 6/2006 Willows et al.
2007/0095870 A1 * 5/2007 Griffith ..... A45C 13/30 224/219
2008/0006659 A1 * 1/2008 Cain ..... A45C 1/04 224/222
2008/0203127 A1 8/2008 Castillo-Garrison
2008/0217369 A1 * 9/2008 Sloot ..... A61F 5/0104 224/222
2009/0007597 A1 * 1/2009 Hanevold ..... A44C 5/0015 63/1.14
2009/0039121 A1 * 2/2009 Paul ..... A44C 5/0007 224/222
2009/0050657 A1 * 2/2009 Woolery ..... A45F 3/14 224/183
2009/0127302 A1 * 5/2009 Pruitt ..... B25B 23/00 224/219
2011/0031290 A1 * 2/2011 Remo ..... A45F 5/00 224/222
2011/0167536 A1 * 7/2011 Kellerhals ..... A41D 20/00 2/170
2011/0254225 A1 * 10/2011 Doherty ..... A44B 5/002 273/287
2012/0061268 A1 3/2012 Turner
2012/0080462 A1 * 4/2012 Hajarian ..... A45F 5/00 224/219
2012/0080464 A1 * 4/2012 Ericksen ..... A44C 5/0007 224/267
2012/0267403 A1 * 10/2012 Ward, Jr. ..... A45F 5/00 224/219
2013/0074545 A1 * 3/2013 Moloney ..... A44C 25/007 63/3.1
2014/0263495 A1 * 9/2014 Koch ..... A45F 5/00 224/222
2014/0263499 A1 * 9/2014 Carter-Cohen ..... A45F 5/022 224/267
2017/0099928 A1 * 4/2017 Krebsbach ..... A45C 13/001

OTHER PUBLICATIONS

"Armband Bait Bag with Number clip" Etsy.com, Retrieved from https://www.etsy.com/in-en/listing/494032296/armband-bait-bag-wnumber-clip?ga_order=most_relevant&ga_search_type=all&ga_view_type=gallery&ga_search_query=dog%20show%20armband&ref=sr_gallery-1-10 on Jan. 15, 2018; 4 pages, Published on Mar. 21, 2014.

"Berner Sennenhund Armband Number Holder", Dogfan.com, Retrieved from http://www.dog-fan.lv/en/armband-number-holders/berner-sennenhund-armband-number-holder-dogfan.html on Jan. 15, 2018; 2 pages, Published on Sep. 8, 2017.

"New Swarovski Crystal Arm Bands", Jewlnickleather.com, Retrieved from http://www.jewlnickleatherco.uk/new-swarovski-crystal-arm-bands-ring-number-clips-4370-p.asp on Jan. 15, 2018; 1 page, Published on Nov. 6, 2015.

"Dog Bait Bag with Number Holder Clip", Dogfan.com, Retrieved from http://www.dog-fan.lv/en/dog-bait-bags-treat-pouch/dog-bait-with-number-holder-clip-dogfan.html on Jan. 15, 2018; 1 page, Published on Dec. 18, 2015.

"Bling Show Arm Band—Number Holder", Wooferwares.com, Retrieved from http://wooferwares.biz/product/bling-show-arm-band-number-holder-adjustable/ on Jan. 15, 2018; 2 pages, Published on Aug. 15, 2015.

* cited by examiner

WEARABLE DECORATIVE BAND SYSTEMS

CROSS-REFERENCE TO RELATED APPLICATION

This application claims the benefit of U.S. Provisional Application No. 62/456,216, filed Feb. 8, 2017, entitled "Interchangeable Armband Number Holder Device, System And Method", which is hereby incorporated herein by reference in its entirety.

FIELD OF THE DISCLOSURE

The present disclosure relates generally to the field of garments such as garment devices for holding number identification tags. More specifically, the present disclosure relates to wearable decorative band systems such as for use at professional or amateur pet shows.

BACKGROUND

Identification Numbers put under rubber bands in general have been known in the pet show and sports environment for years for displaying useful information, such as an Identification Number. During pet/animal show events, for example, animal handlers are known to attach their number identification cards under rubber bands, or more recently, different color or style armbands. Likewise, athletes have been known to wear number identification armbands during, for example, races.

SUMMARY

Shortcomings of the prior art are overcome and additional advantages are provided through the provision, in one embodiment, of decorative band system to be worn around a limb of a user. The system includes, for example, an elongated band, a first connector, and a second connector. The elongated band is sized to be disposed and retained around the limb of the user, and includes an inner surface disposable towards the limb of the user and an outer surface facing away from the limb of the user. The first connector is attached to the elongated band between the first longitudinal edge and the second longitudinal edge, and releasably attachable to one or more interchangeable decorative ornamentation. The second connector is attached to the elongated band and releasably connectable to a card so that the card is spaced apart from the elongated band. The elongated band and the second connector are configured so that when the system is worn on the limb of the user and connected to the card, the card is maintainable in a fixed relationship alongside and parallel to the limb of the user.

In another embodiment, a method includes for example, attaching an elongated band having one or more releasably attachable decorative ornamentation around one's limb, and fixedly supporting a card from the elongated band so that the card is fixedly disposed alongside and parallel to one's limb with an outer face of the card facing outwardly from one's limb.

BRIEF DESCRIPTION OF DRAWINGS

The foregoing and objects, features, and advantages of one or more aspects of the disclosure are apparent from the following detailed description taken in conjunction with the accompanying drawings in which.

DETAILED DESCRIPTION OF THE DISCLOSURE

Figure 1:
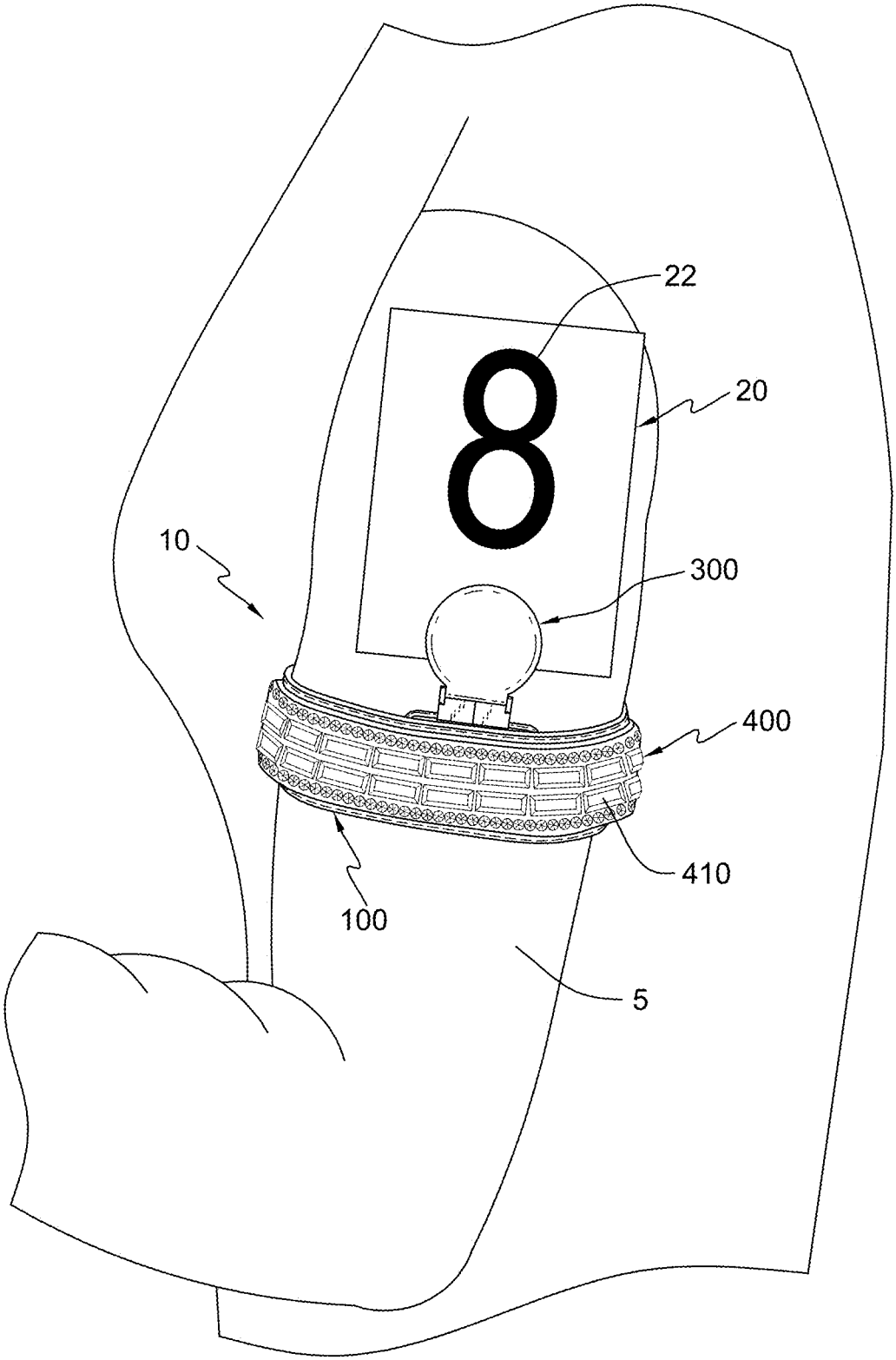
FIG. 1 is a perspective view of a decorative band system according to an embodiment of the present disclosure worn on an arm of a person with an identification card disposed vertically above the decorative band system and with decorative ornamentation disposed along the longitudinal length of the decorative band system.

Aspects of the present disclosure and certain features, advantages, and details thereof, are explained more fully below with reference to the non-limiting examples illustrated in the accompanying drawings. Descriptions of well-known materials, fabrication tools, processing techniques, etc., are omitted so as not to unnecessarily obscure the disclosure. It should be understood, however, that the detailed description and the specific examples, while indicating aspects of the disclosure, are given by way of illustration only, and not by way of limitation. Various substitutions, modifications, additions, and/or arrangements, within the spirit and/or scope of the underlying concepts will be apparent to those skilled in the art from this disclosure.

As described in greater detail below, in some embodiments, the present disclosure is directed to garment devices or armband systems for use at animal shows, primarily dog shows, though such is not considered limiting. For example, the present disclosure may provide for an attractive, neat appearing number identification wearable armband holder which is adjustable, interchangeable and/or versatile enough to removably secure and hold multiple styles, sizes, shapes, and thicknesses of adornment and also to removably secure and display useful information, such as a number identification.

In some embodiments, the present disclosure relates to garment devices or armbands having a removable attachment means, manual adjustment means, and a fastener for displaying useful information. In still other embodiments, garment devices may include at least one ornament (ornamental member or ornamentation device) with attachment means, wherein said attachment means are releasable.

In some preferred embodiments, garment devices or armbands may include elastic means to provide for a tight fit on the user. The elastic means can be made from any elastic material. The garment devices or armbands can be designed and worn on any portion of the body, such as on an arm or leg, but a preferred use is for the arm. The fastener is configured to allow information to be attached to it, such as the user's number. This information can be fastened to the armband, using the fastener, by any conventional and adjustable attachment means such as clip means. In certain embodiments, although not meant to be limiting, the fastener includes a clip, such as a mitten clip or a suspender clip, fixedly secured to the armband. The removable attachment means may include, for example, hook and loop means (i.e. Velcro®). The manual adjustment means may include an adjustment member, for example, a flat metal slide.

In alternate embodiments, the armband may be made of any common materials used for garments, for example, nylon, cotton, spandex, leather, neoprene, or other web or fabric material would suffice. It may include a separate means for providing elasticity, an adjustable length, and/or a tight fit.

As described in greater detail below, the present disclosure in some embodiments, provides armbands designed to display useful information, such as a number identification, and also be interchangeable depending on the user's individuality, style and/or the user's attire, a particular product or message, or a breed the user wishes to endorse at any one particular time. The present disclosure overcomes the problem of a user having to buy multiple, separate armbands for each of these occasions. The present disclosure is directed to overcoming deficiencies with known Number Identification Holders and the present disclosure provides the user with the convenience and versatility of different styles/looks while still maintaining the ability to display useful information.

In addition, in some embodiments, the armbands allows one to a secure number holder which can be worn at both indoor and outdoor events. The number stays in place, secured to the arm. Fast movement indoors and wind at outdoor events, may not move the clip so that the number attached cannot flap in the breeze. This may be desirable in competing so that one's identification number is visible to everyone at the event at all times. As such, the present disclosure provides number identification armbands that allow users to interchange and swap out one style, color, or other ornamentation for another. For example, the present disclosure in some embodiments relates to a garment devices, i.e. armbands, which can be worn by a user to display useful information, have a tight fit by means of an elastic connection and be interchangeable in its appearance depending on the user's choice. In some embodiments, the present disclosure may provide a dog show elasticated (or elasticized) adjustable armband number holder that is customizable and interchangeable in style and/or design. The present disclosure also relates to a number identification holders for animal shows and provides a means for securely attaching the number identification tags in a manner that is neat in appearance and function, and is interchangeable according to the user's preference. Apart from animal show usage such as dog show usage, there also is a use for such decorative bands such as armbands such as in the sports area, i.e. running races.

For purpose of this disclosure, a number identification holder or display is defined as a device or means for displaying useful information, such as an assigned number identification, for use at amateur or professional animal (i.e. dog, horse, and pet) shows. The term is also commonly known or referred to as a show number holder or display, show card holder or display, exhibitor number holder or display, show ring holder or display, dog show exhibitor holder or display, or ring number holder or display.

FIG. 1 illustrates a decorative band system 10 according to an embodiment of the present disclosure. For example, the present disclosure may provide decorative band system and kits, which may be used as a customizable armband that allows a person, individual, or user 5 to interchange the armband while at the same time display useful information, such as number identifications for a dog-show, though such is not considered limiting.

As show in FIG. 1, in this illustrated embodiment, decorative band system 10 may include an elongated band 100, a first connector (not shown in FIG. 1), a second connector 300, and releasably attachable decorative ornamentation 400 having a plurality of crystal ornaments 410. A card 20, such as a conventional number identification card, may be attached at a lower edge portion 22 of card 20 to second connector 300 so that card 20 may be disposed in a vertically upright orientation, e.g., spaced entirely away from elongated band 100. Card 20 may include indicial 22 such as information indicia, images or other indicia. Elongated band 100 secures decorative band system 10 around, for example, a person's upper arm or forearm.

As described in greater detail below, elongated band 100 and second connector 300 may be configured so that when system 10 is worn on a limb such as an arm of a person and connected to a card, the card is maintainable in a fixed relationship alongside, adjacent to, and parallel to the limb of the person during movement of the system and card by the person. In addition, the card is maintainable in a fixed relationship alongside, adjacent to, and parallel to the limb of the person in the event of wind or a breeze. Maintaining the card in a fixed vertical orientation makes it easy for observes to view the card and the contents thereon.

Figure 2:
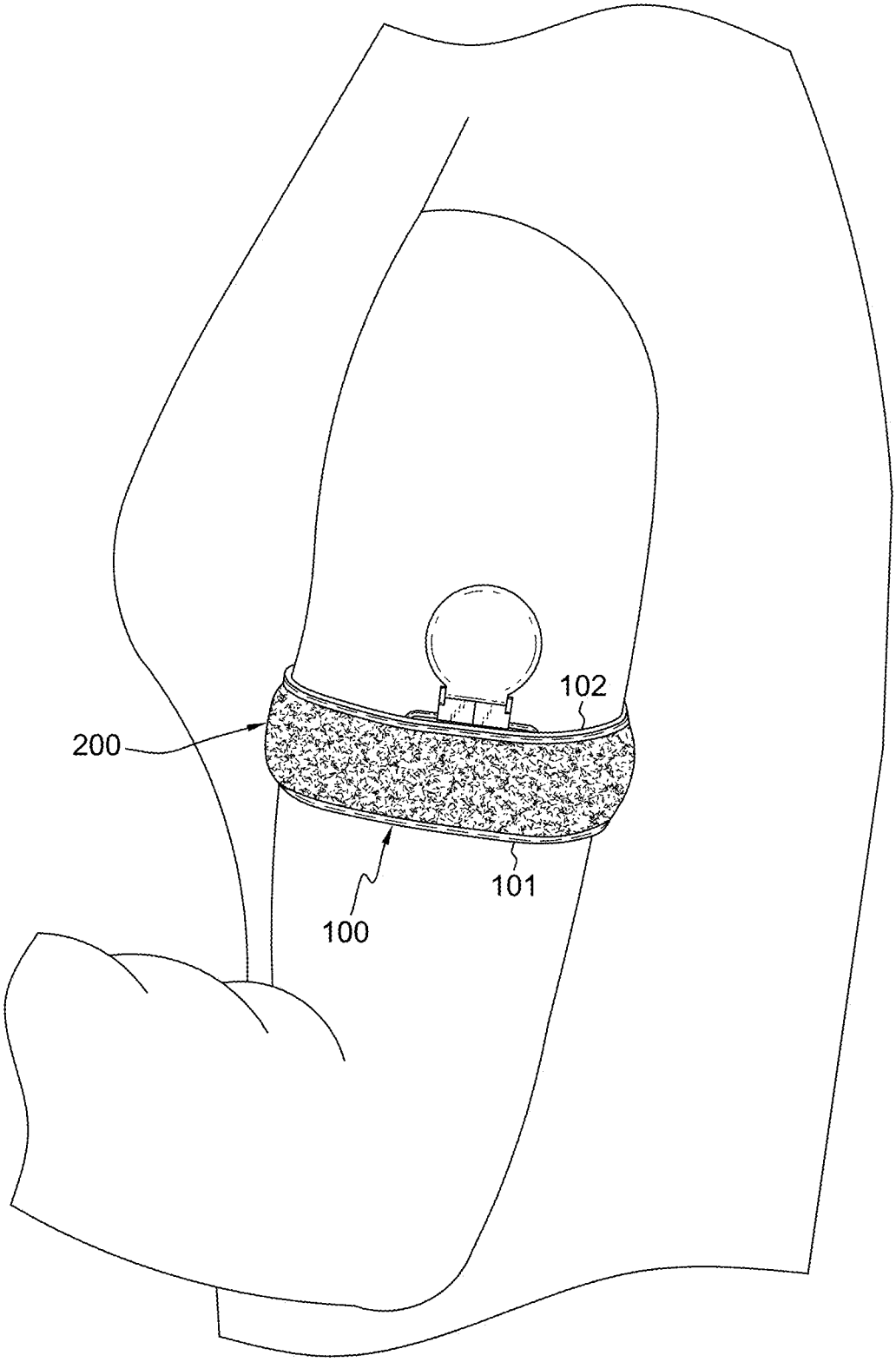
FIG. 2 is a perspective view of the decorative band system of FIG. 1 without the card and without the decorative ornamentation.

FIG. 2 illustrates decorative band system 10 (FIG. 1) with card 20 (FIG. 1) removed, and with interchangeable decorative ornamentation 400 (FIG. 1) removed, allowing observation of first connector 200. Elongated band 100 defines a first lower longitudinal edge 101 and a second upper longitudinal edge 102. First connector 200 may be a hook portion or a loop portion of a hook-and-loop fastener (e.g., VELCRO) operably attached such as sewn to elongated band 100 between first lower longitudinal edge 101 and second upper longitudinal edge 102. For example, the hook or loop portion of the hook-and-loop fastener may extend along the observable portions of a person's arm, e.g., front, side, and rear portions of the person's arm. As described below, the other portion of the hook-and-loop fastener (not shown) may be operably attached to decorative ornamentation 400 (FIG. 1).

Figure 3:
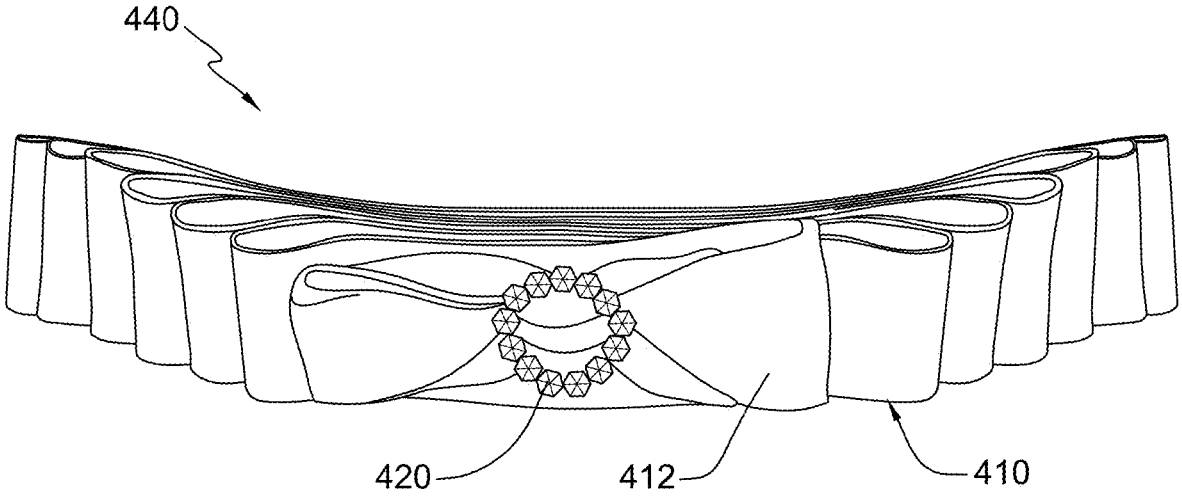
FIG. 3 is a front perspective view of a decorative ornamentation according to an embodiment of the present disclosure, which decorative ornamentation may be interchangeably employed in the decorative band system of FIG. 1.
Figure 4:
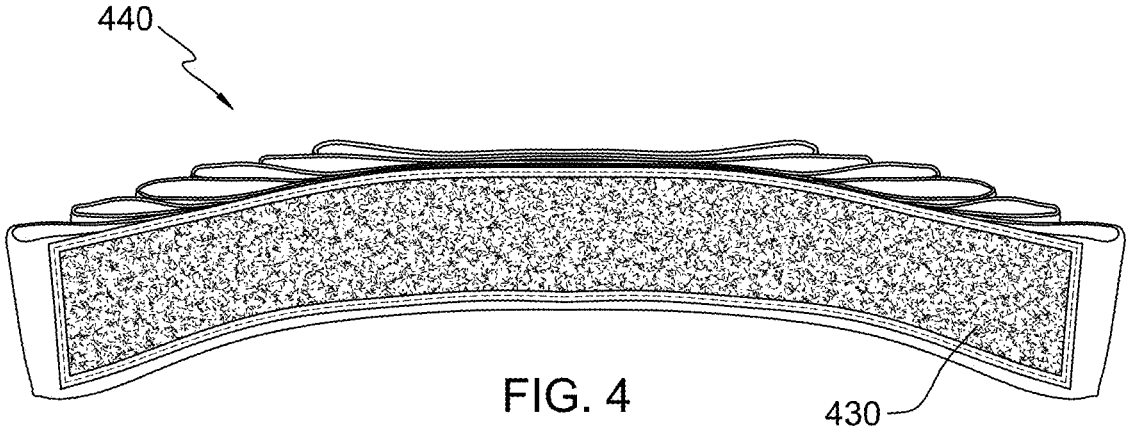
FIG. 4 is a rear perspective view of the decorative ornamentation of FIG. 5.

FIG. 3 illustrates a decorative ornamentation 440 according to an embodiment of the present disclosure, which decorative ornamentation 440 may be interchangeable with decorative ornamentation 400 of FIG. 1. With reference again to FIG. 3, decorative ornamentation 440 may include a front side having a bow 410 and a crystal loop 420. In this illustrated embodiment, bow 410 may be formed by appropriately folding an elongated piece of fabric 412 back and forth and stitching portions of the folded portions together. As shown in FIG. 4, a rear side decorative ornamentation 440 may include a connector 430. For example, connector 430 may be the other of the hook portion or the loop portion of a hook-and-loop fastener so that connector 430 and first connector 200 (FIG. 2) are operable to connect decorative ornamentation 440 to elongated band 100 (FIG. 2). The bow may be of any color or colors such as black, white, green, blue, yellow, orange, red, pink, etc. The crystal loop may be round, square, oval, triangular, rectangular, or other polygonal shape. It will be appreciated that other ornamentation or no ornamentation may be disposed in the center of the ribbon.

Figure 5:
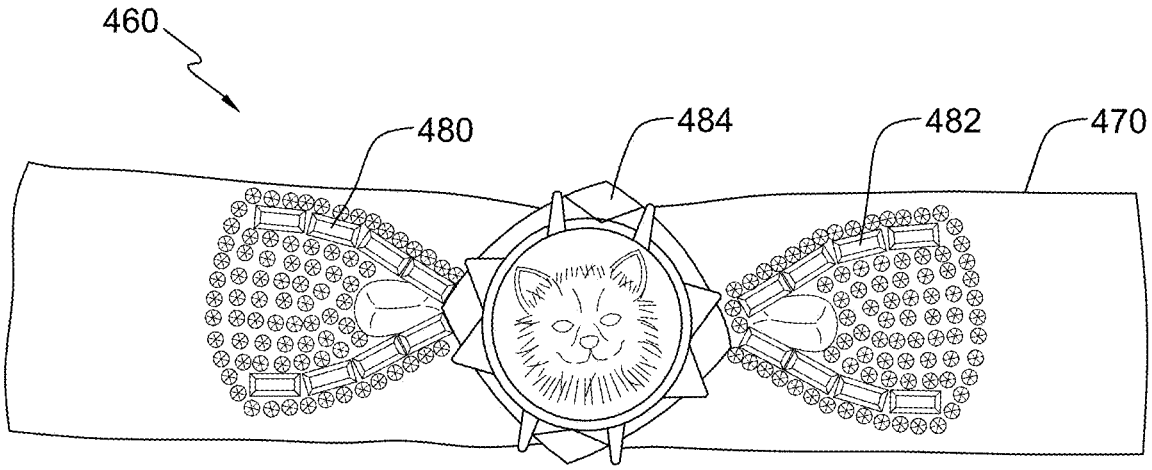
FIG. 5 is a front elevational view of decorative ornamentation according to an embodiment of the present disclosure, which decorative ornamentation may be interchangeably employed in the decorative band system of FIG. 1.
Figure 6:
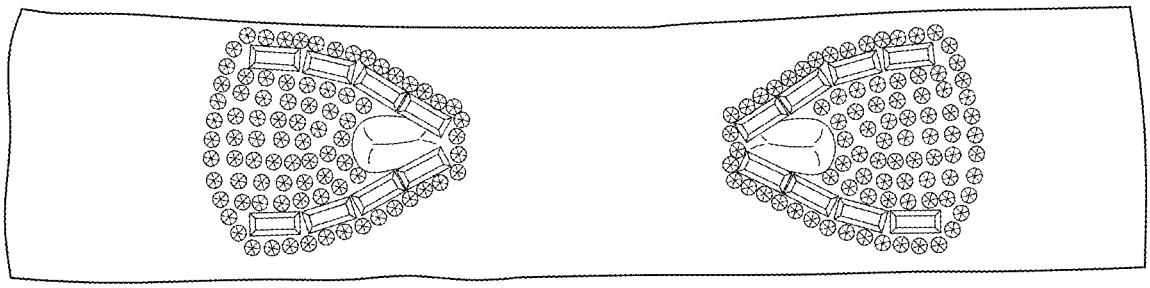
FIG. 6 is a front elevational view of decorative ornamentation of FIG. 5 with the releasably attachable pin removed.
Figure 7:
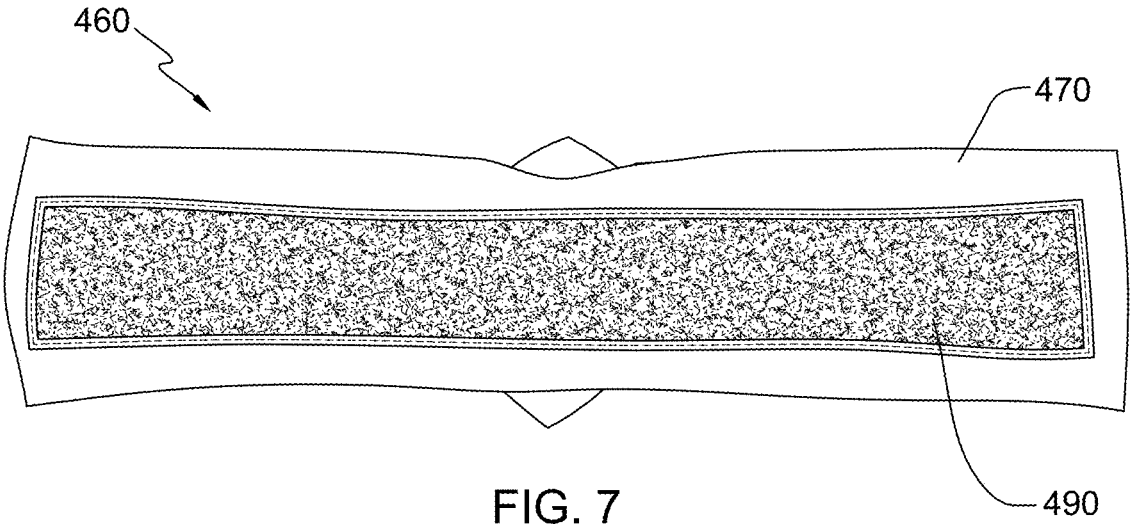
FIG. 7 is a rear elevational view of the decorative ornamentation of FIG. 5.

FIG. 5 illustrates a decorative ornamentation 460 according to an embodiment of the present disclosure, which decorative ornamentation 460 may be interchangeable with decorative ornamentation 400 of FIG. 1. With reference again to FIG. 5, decorative ornamentation 460 may include an elongated member 470 such as a piece of fabric or webbing having a front side, a first crystal ornament 480, a second crystal ornament 482, and a pin 484 disposed therebetween. First crystal ornament 480 and second crystal ornament 482 may be securely attached to elongated member 470 such as with an adhesive or other suitable attachment means. Pin 484 may include an image of a dog such as a painted or photographic image. Pin 484 may be removable as shown in FIG. 6. This allows a user to attach a different pin to the elongated member between the two crystal ornaments, and thus, readily change the appearance of the decorative ornamentation. For example, a user may coordinate pins having images of dogs to the dog being shown at a dog show while the user is wearing the decorative band system. As shown in FIG. 7, a rear side of elongated member 470 may include a connector 490. For example, connector 490 may be the other of the hook portion or the loop portion of a hook-and-loop fastener so that connector 490 and first connector 200 (FIG. 2) are operable to connect decorative ornamentation 460 to elongated band 100 (FIG. 2).

Figure 8:
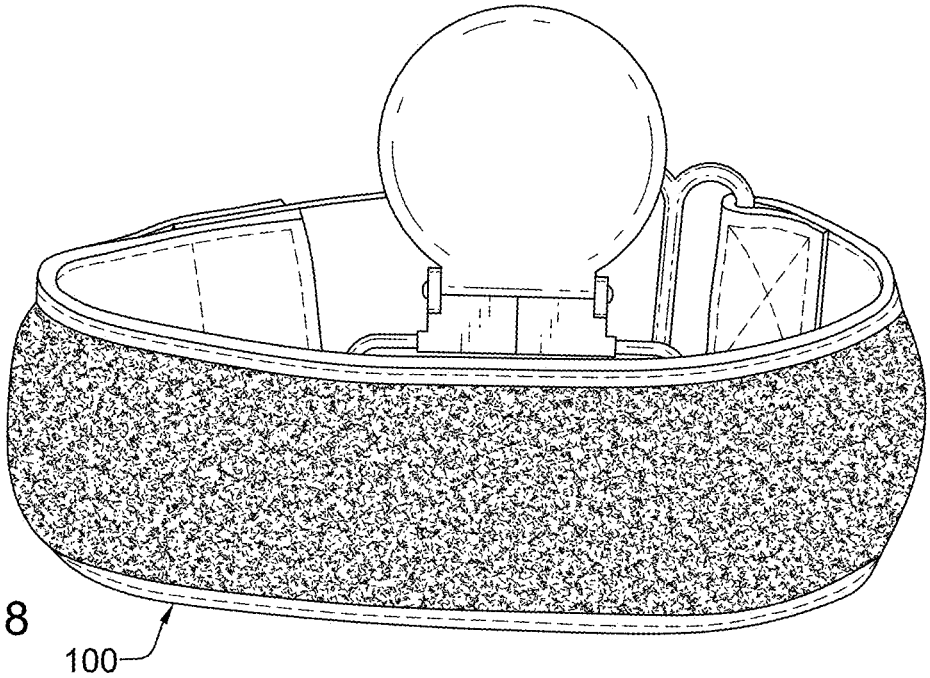
FIG. 8 is an enlarged, front perspective view of the decorative band system of FIG. 1.

With reference to FIG. 8, elongated band 100 may be formed from one or more elements, and desirably form an adjustable continuous loop which fits securely on a limb of the user such as an arm of the user.

Figure 9:
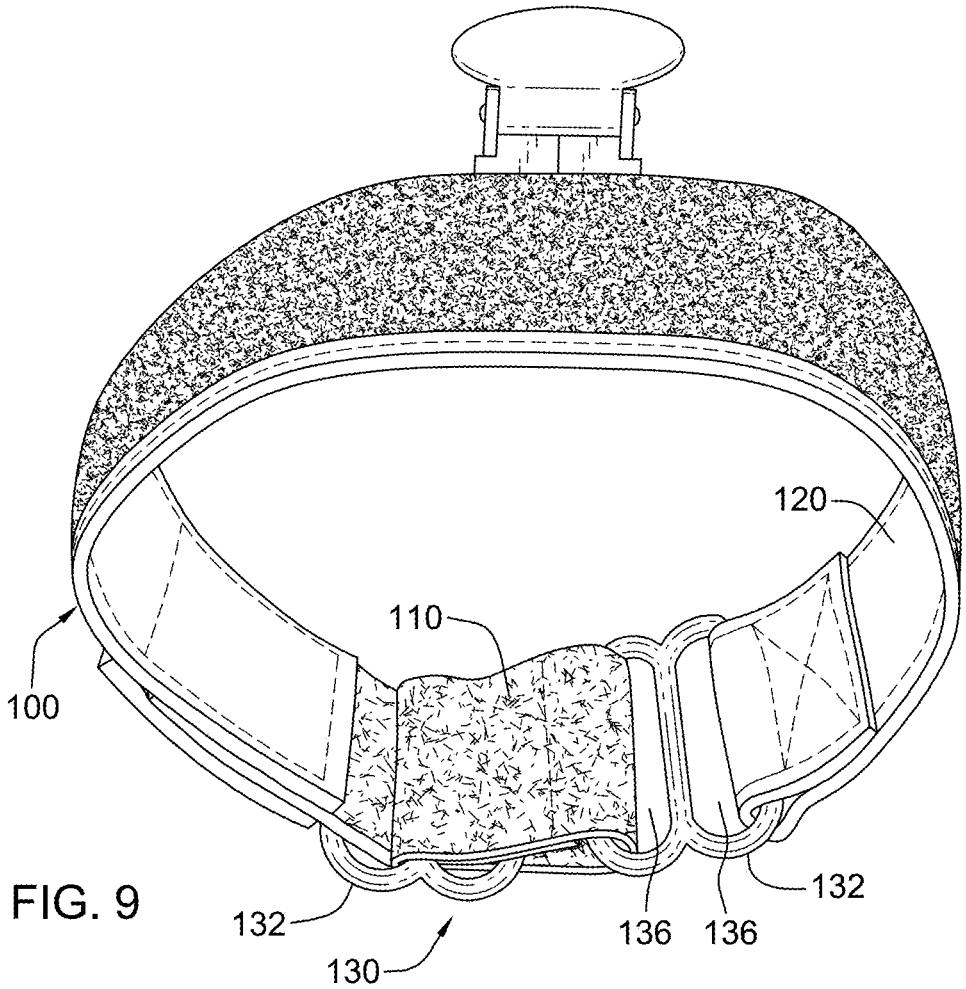
FIG. 9 is an enlarged, bottom perspective view of the decorative band system of FIG. 1.

As shown in FIG. 9, elongated band 100 may include at least one piece of resilient or elasticized material 110, or elastic means, to provide for a tight fit on the user. The elastic means/material 110 can be made from any elastic, resilient, or stretchable material. Elongated band 100 may also include at least one web material or fabric strap 120, wherein web material or fabric strap 120 may include at least one or more pieces of webbing or fabric material. For example, fabric strap 120 may include a combination of polypropylene webbing and grosgrain ribbon, though such is not considered limiting and other materials can also be used and are considered within the scope of the present disclosure. For example, fabric strap 120 may comprise one or more pieces of material such as neoprene to increase comfort while still allowing breathability. In still other embodiments, at least one of any common materials used for garments, for example, nylon, cotton, spandex, leather, or other fabric material would suffice for fabric strap.

In certain embodiments, elastic material 110 may be about ¾ inches (about 1.9 cm) wide by about 6 inches long (about 15.2 cm), but one of ordinary skill in the art will recognize that the length of elastic material 110 may be longer or shorter depending on the size required for any particular user. In alternate embodiments, the width of elastic material 110 may be in the range of about 0.5 inch (about 1.27 cm) to about 2 inches (5.1 cm). In alternative embodiments, the length of elastic material 110 is in the range of about 4 inches (about 10.2 cm) to about 7 inches (about 17.8 cm).

Fabric strap 120 may be about 1 inch (about 2.54 cm) wide by about 9 inches long (about 22.9 cm), but one of ordinary skill in the art will recognize that the length of fabric strap 120 may be longer or shorter depending on the size required for any particular user, and depending on whether one or more pieces of webbing or fabric are used to make fabric strap 120. In alternate embodiments, the width of fabric strap 120 may be in the range of about ¾ inch (about 1.9 cm) to about 3 inches (about 7.6 cm). In alternative embodiments, the length of fabric strap 120 may be in the range of about 7 inches (about 17.8 cm) to about 11 inches (about 28 cm).

Once assembled, the circumference of elongated band 100 may be about 8 inches to about 14 inches long (about 20.3 cm to about 35.5 cm). The width of the elongated band 100 may be about ¾ inches to about 2 inches (about 1.9 cm to about 5.08 cm) or to about 3 inches (about 7.6 cm).

To allow for adjustment of the length of the elongated band 100 on a continuous basis, elongated band 100 may include a manual (or slideable) adjustment means 130. The manual adjustment means 130 may provide for adjusting and tightening elongated band 100 around an arm or other limb of the wearer/user.

In some embodiments, manual adjustment means 130 may include at least one slideable, fabric strap length adjustment member 132, through which elastic material 110 slideably intersect, and wherein adjustment member 132 is selectively movable generally longitudinally of elastic material 110. In other embodiments, slideable adjustment member 132 includes two sliders. Each slider defines a pair of parallel through-extending slots 136 located at opposing sides thereof. When assembled, the sliders are slideably attached to the elastic material 110 by extending the elastic material 110 through both slots 136.

In some embodiments, the sliders comprise metal slides that are about ¾ inches in length and width and nickel plated. In other embodiments, the manual adjustment means can be any of the following: stainless steel metal slide, cast metal slides, plastic/nylon slides, or other suitable slides. The slides may be rounded or flat. Depending on the width of fabric strap 120, the slides may be in the range of about ½ inch to about 2 inches, including but not limited to about ¾ inch, about 1 inch, about 1½ inches.

Adjustment means can be of different types or designs. For example, in other embodiments, adjustment means may include, without limitation, a pass-through loop adjuster, clasp buckle, metal strap adjuster, a quick release strap adjuster, or hook-and-loop (Velcro®), as manual adjustment means. The size and fit of the decorative band system may be adjusted by sliding the adjustment member 130 along the lengths of the elastic material thereby allowing for maximum user comfort. Adjustment member 130 is affixed to elastic material 110 using known methods (sewn, stitched, glues, and the like).

To secure elongated band 100 to the user's arm, elongated band 100 fits around the person's arm (ideally below the shoulder and above the elbow) and is then adjusted for a secure fit and locked in place with elastic member 110 and adjustment member 130. Alternatively, elongated band 100 may also be similarly secured to the user's forearm area, even possibly, the upper thigh of the user's leg.

Figure 10:
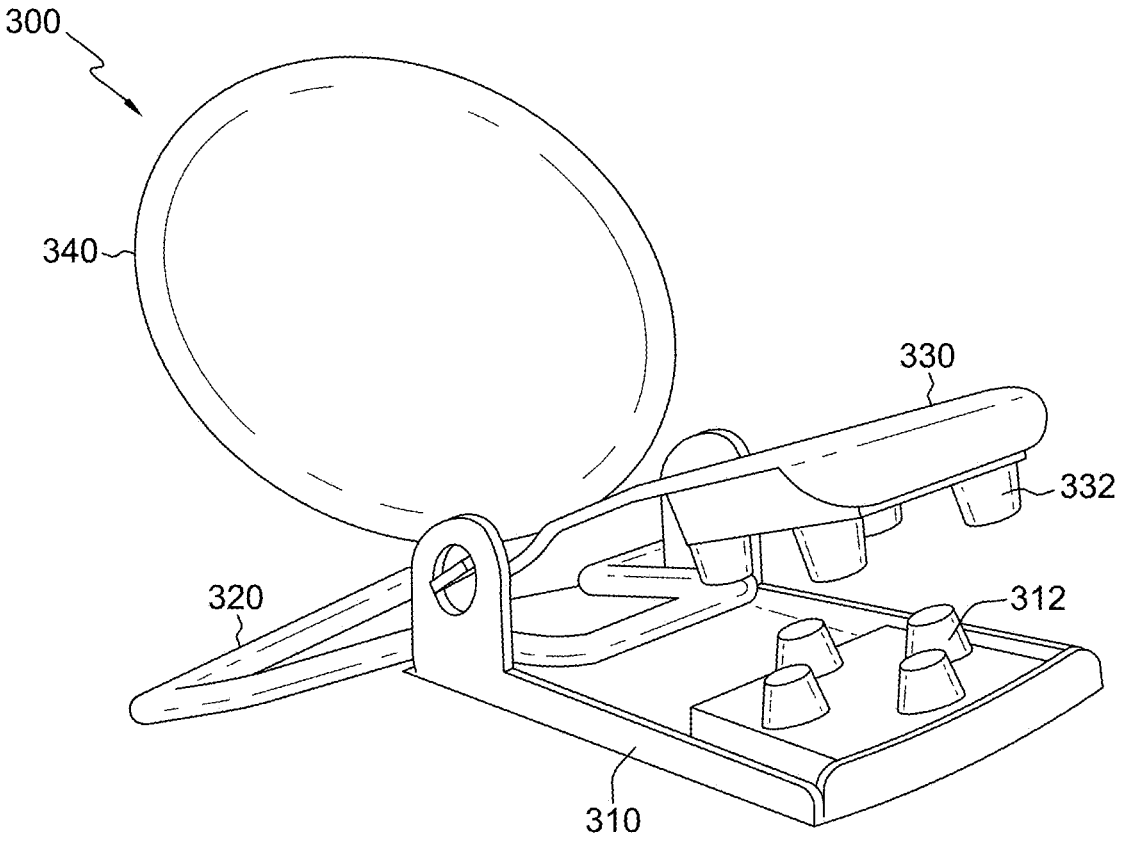
FIG. 10 is an enlarged perspective view of the second connector in an open position of the decorative band system of FIG. 1.

FIG. 10 illustrates an embodiment of second connector 300. For example, second connector 300 may include a fixed leg 310 having teeth 312, a loop 320 attached to fixed leg 310, a movable leg 330 having teeth 332, and a movable lid 340. Second connector 300 is configured so that when movable lid 340 is disposed in an open configuration, leg 330 moves away from fixed leg 310.

Figure 11:
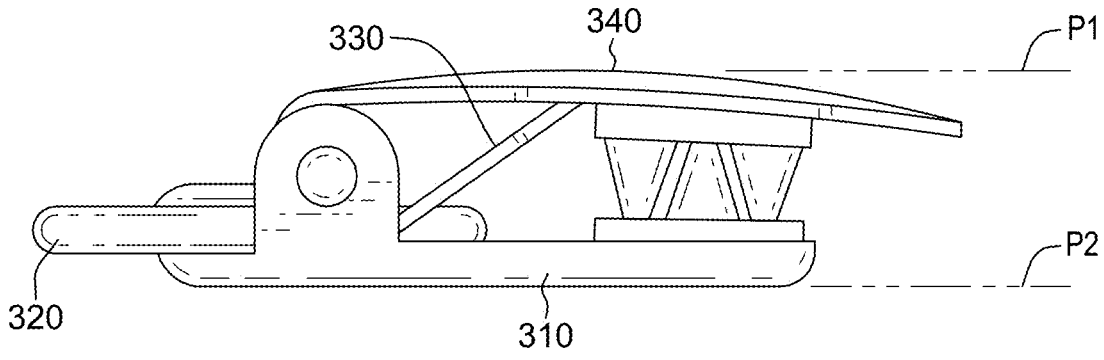
FIG. 11 is a side elevational view of the second connector of FIG. 10 in a closed position.

Movable lid 340 may be pivoted or rotated towards movable leg 330 by a user as shown in FIG. 11 to cause the teeth of leg 330 to clamp against the teeth of leg 310, for example, with a portion of the card (not shown in FIG. 11) disposed therebetween, and also lock leg 330 in clamping engagement with leg 310 and rotate loop 320 to align with and be disposed in a fixed relationship to leg 310. As observed in FIG. 11, the bottom surface of leg 310 and the top surface of lid are generally disposed in parallel planes P1 and P2.

With reference again to FIG. 9, approximately half-way or midway from adjustment member 130 longitudinally along elongated band 100, decorative band system 10 (FIG. 1) includes second connector 300, wherein second connector 300 is provided to fasten to a conventional number identification card (or other useful information display, not shown in FIG. 9), for example, which typically may be worn by a handler during an animal show, though such is not considered limiting. For example, a number identification card may also conventionally be used during a walking, jogging or running session or race.

Figure 12:
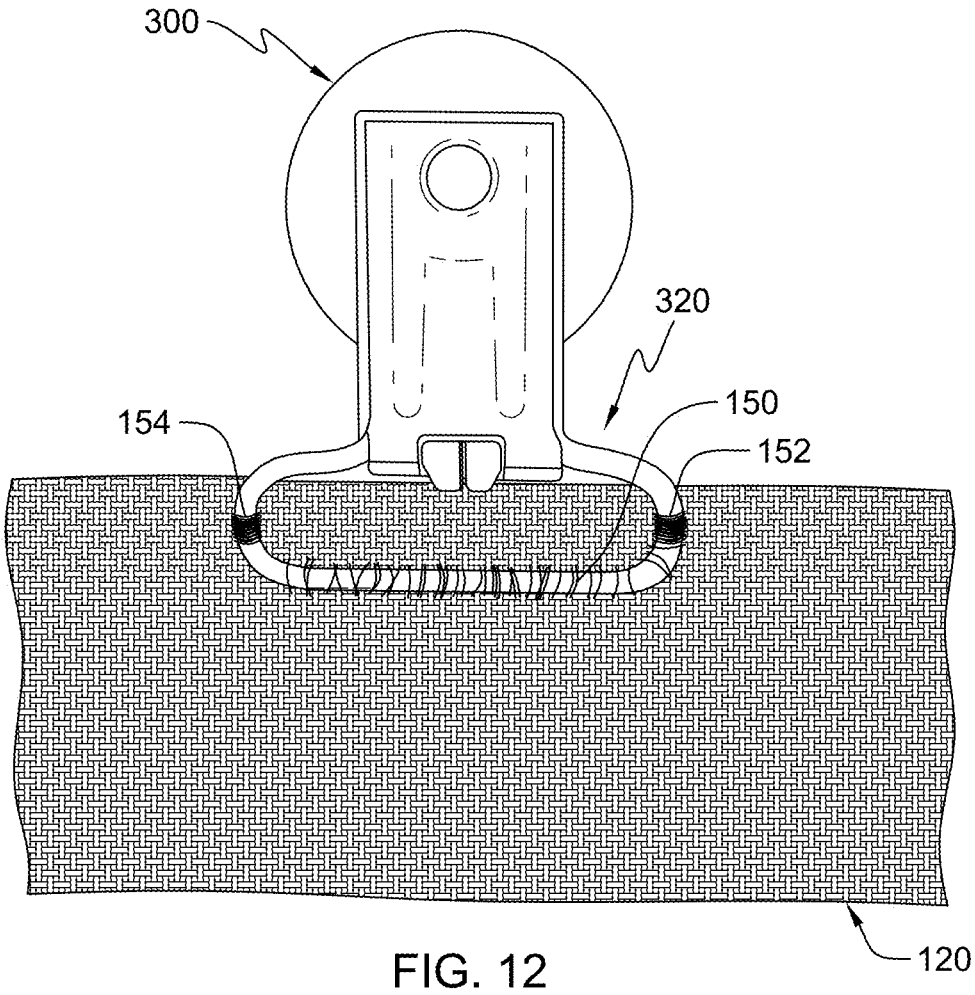
FIG. 12 is an enlarged, side elevational view of the second connector and a portion of the elongated band of the decorative band system of FIG. 1 illustrating the attachment of the first connector to the elongated band.

As shown in FIG. 12, second connector 300 may be fixedly attached to an inside surface of fabric strap 120. For example, elongated loop 320 may be attached to fabric strap 120 with stitches. Stitches 150 may be provided along the straight elongated portion of loop 320, and stitches 152 and 154 may be provided along curved portions of loop 320 to fixedly attach loop 320, and thus, fixedly attach second connector 300 to fabric strap 120, e.g. second connector 300 is inhibited from pivoting relative to the elongated band. For example, the combination of the width of the elongated band and the attachment thereto of the second connector results in the clip being maintained in a fixed position paralleled to and along and against the user's limb, e.g., arm, when wearing the decorative band system.

Second connector 300 is not considered limited to any one particular connection device, and can vary depending on the connection point needed for the conventional number identification card. For example, a second connector 300 may be used where the number identification is a standard piece of paper. Alternatively, second connector 300 may be a badge clip (metal or plastic, etc.), an adhesive clip, a magnetic clip, and other conventional connection configurations are also within the scope of the present disclosure to allow for different types of number identification devices or systems (plastic number ID, cardboard number ID, plastic sleeve for number ID, etc.). Preferably, second connector 300 is fixedly secured (or affixed) to elongated band 100 using conventional means, such as stitching, sewing, gluing or any other known means for securing second connector 300 to fabric strap 120.

Second connector 300 may include the clip fixedly secured to a portion of fabric strap 120. Second connector 300 is operably configured to allow information to be attached to it, such as the user's identification number. This information can be fastened to the elongated band, using the second connector, by any conventional and adjustable clip means, such as a mitten clip, a suspender clip, a pacifier clip although not meant to be limiting. Second connector 300 may be made of different materials and have different shapes. More specifically, the second connector may be designed in different stylish shapes, i.e. oval, round, rectangular, or any other appropriate more ornate shape, while operable, for example, to fasten and hold the number identification card. The second connector may be made of any durable material, such as metal or metal alloy, wood, or plastic. The second connector may have a diameter of about 0.5 inch (about 1.3 cm) to about 2 inches (about 5.1 cm), including for example, about 1.6 inches (about 4 cm).

In other embodiments, a second connector may be removably/detachably attached or secured to elongated band 100 in order to allow different styles of fasteners to be used.

Figure 13:
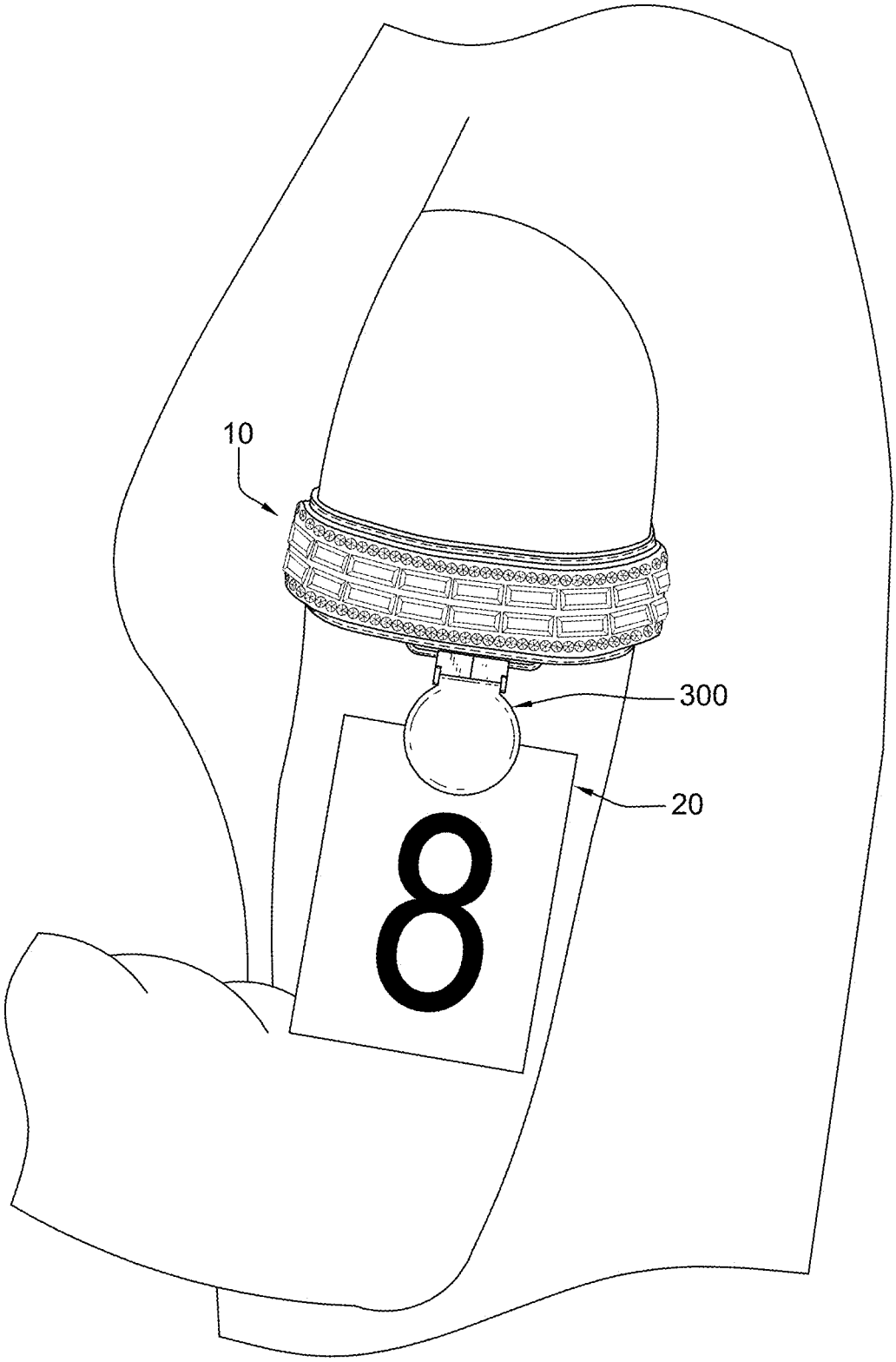
FIG. 13 is a perspective view of the decorative band system of FIG. 1 worn on an arm of a person with the identification card disposed vertically below the decorative band system and with decorative ornamentation disposed along the longitudinal length of the decorative band system.
Figure 14:
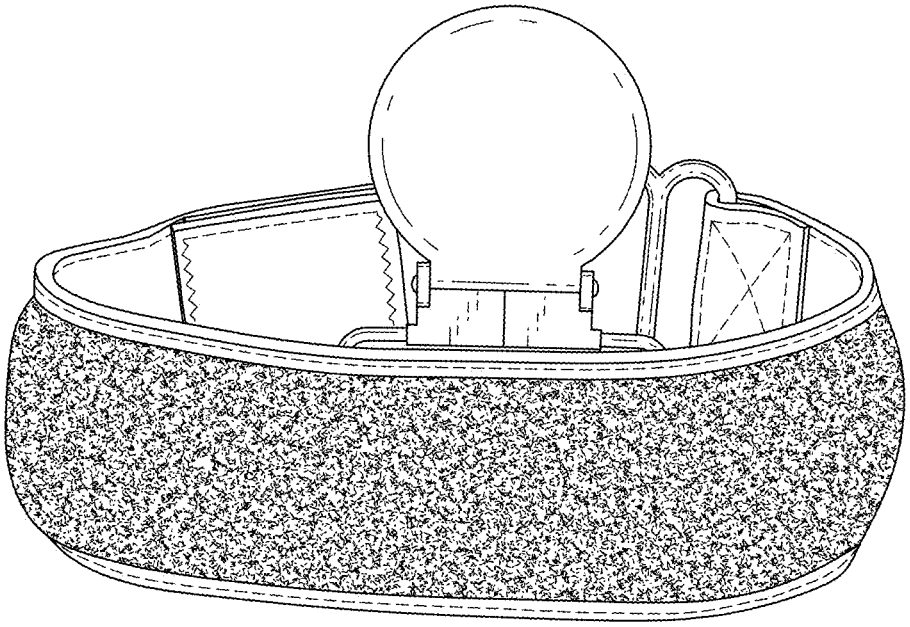
FIGS. 14-21 are various perspective views of the decorative band system of FIG. 1 without decorative ornamentation and without a card.
Figure 15:
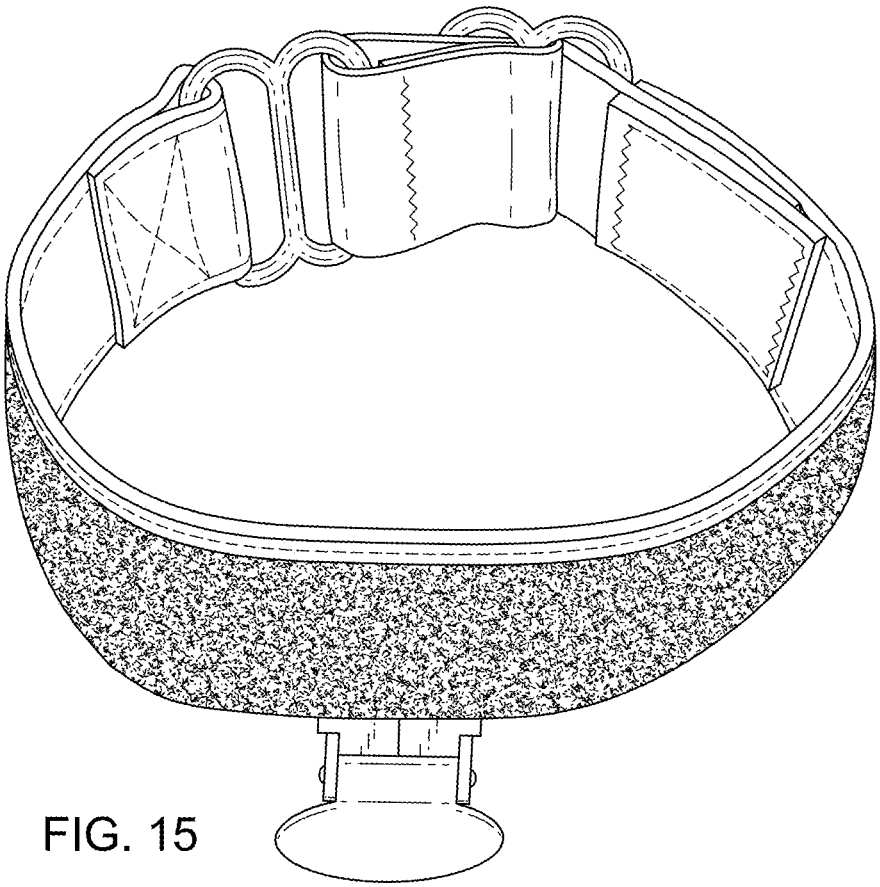
Figure 16:
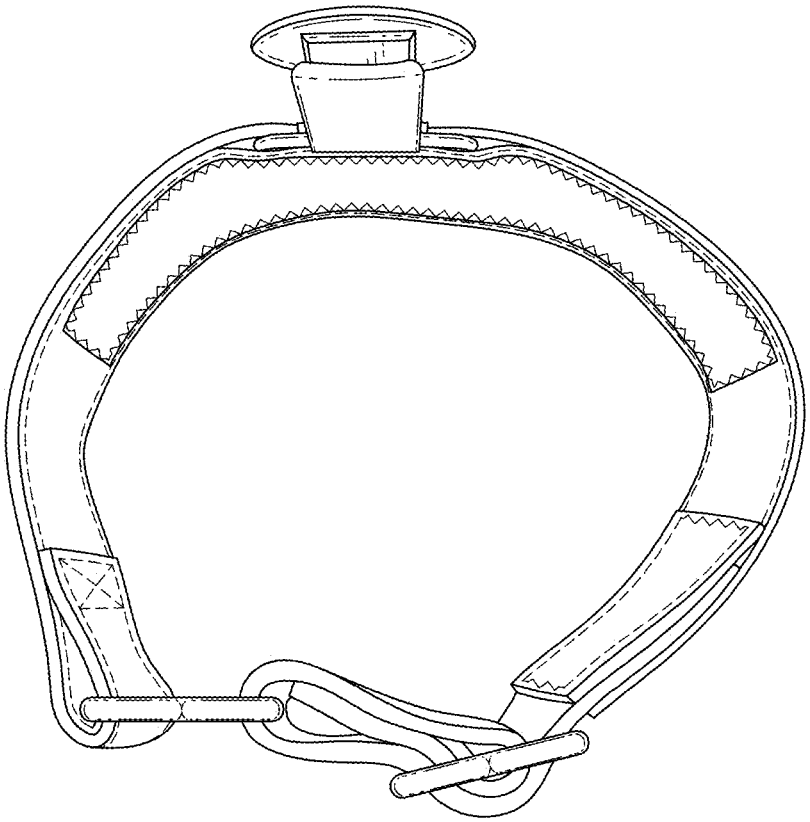
Figure 17:
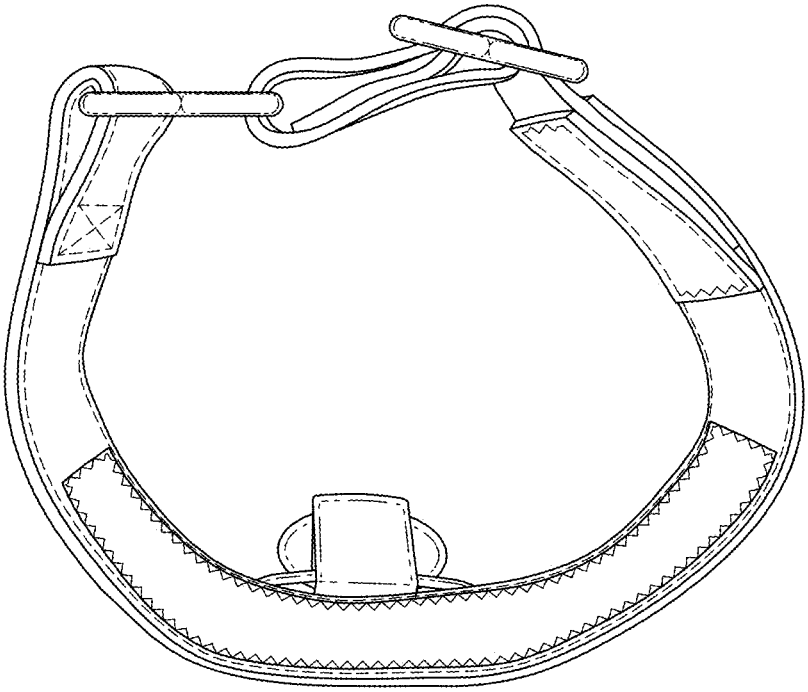
Figure 18:
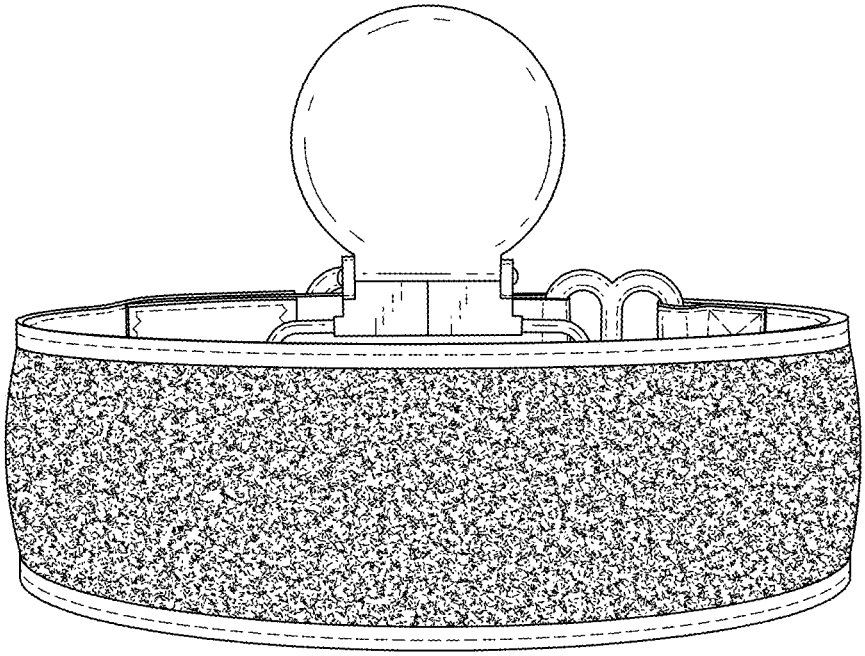
Figure 19:
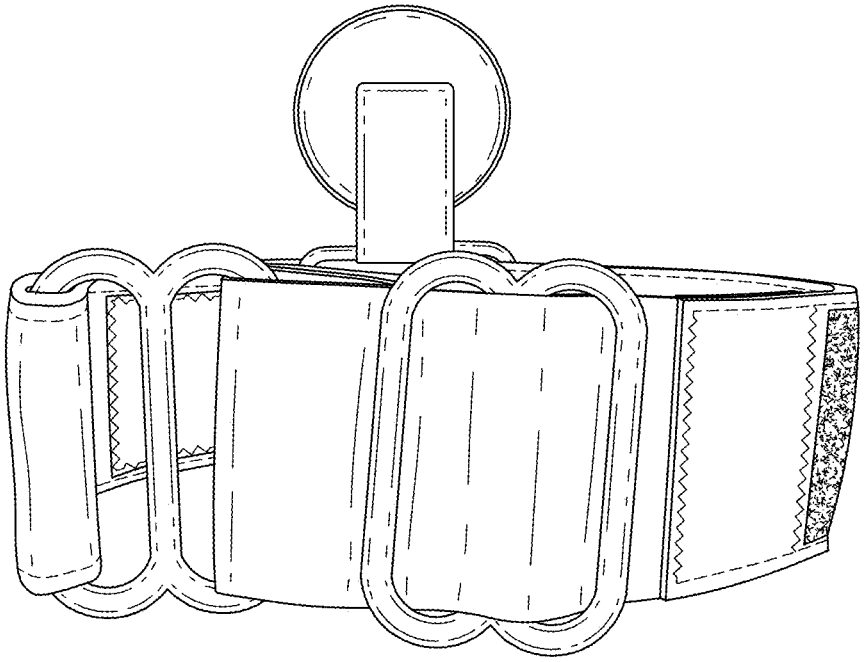
Figure 20:
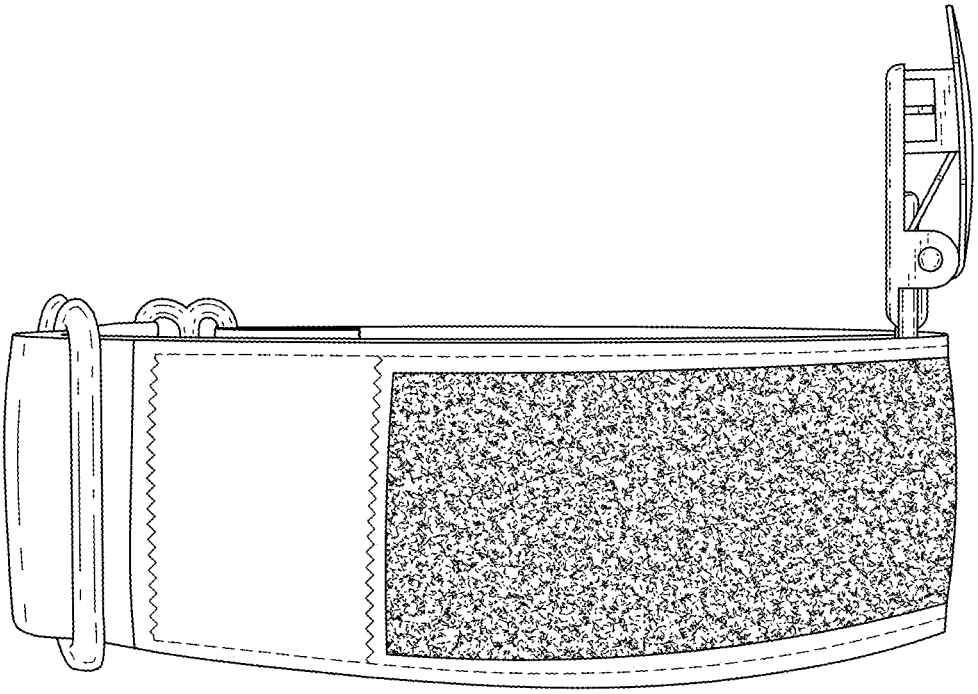
Figure 21:
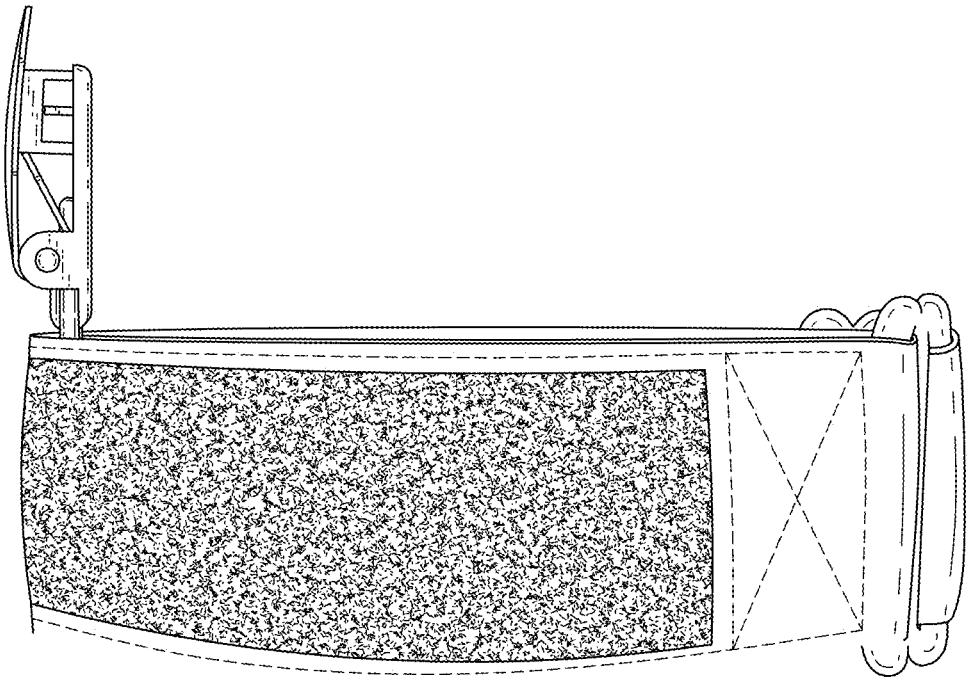

FIG. 13 illustrates decorative band system 10 disposed in an alternative orientation as worn by a user with second connector 300 and card 20 disposed downwardly.

Figure 22:
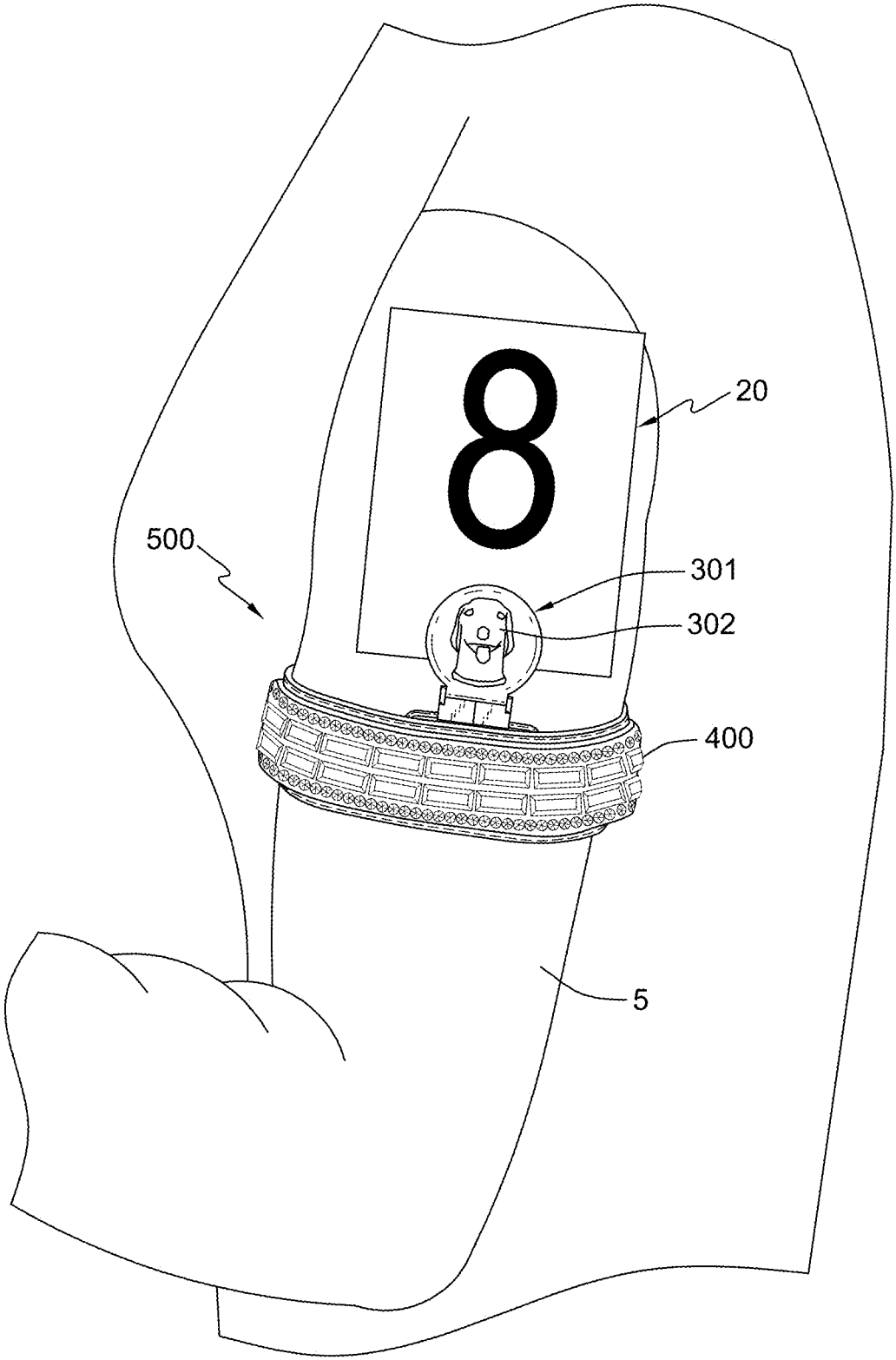
FIG. 22 is a perspective view of a decorative band system according to an embodiment of the present disclosure worn on an arm of a person with an identification card disposed vertically above the decorative band system and with decorative ornamentation disposed along the longitudinal length of the decorative band system.

FIGS. 14-21 illustrate various perspective views of decorative band system 10 of FIG. 1 without the decorative ornamentation;

FIG. 22 illustrates a decorative band system 500 according to an embodiment of the present disclosure worn on an arm of a person 5 with a first connector 301 attached to an identification card 20 disposed vertically above decorative band system 500 and attached to decorative ornamentation 400 disposed along the longitudinal length of decorative band system 500. In this illustrated embodiment, first connector 301 may include an image 302 such as an image of a dog, or other indicia, or other ornamentation The present disclosure is also directed to a method for making a decorative band system such as decorative band system 10. For example, a method according to an embodiment of the present disclosure may include the following steps:

1. Attach one metal slide on the elastic member or belting.
2. Fold elastic member or belting to itself as close to the slide as possible.
3. Sew elastic member or belting to itself by sewing an "x-box" stitch to secure slide.
4. Thread second slide onto elastic belting only sliding through one slot.
5. Thread long end of elastic belting back through secured slide make a loop with one slide attached.
6. Attach 6 inch long ¾ wide Velcro® to the end of the 18 inch long ⅞ inch wide grosgrain ribbon by zig zag stitch.
7. Attach ¾ inch wide Velcro® strip with 18 inch long ⅞" wide grosgrain ribbon attached to the 1 inch wide, 9 inch long polypropylene webbing by aligning the Velcro® 2 inches from one end of the 1 inch wide polypropylene webbing.

8. With Velcro® 2 inches from the end of the 9 inch long 1 inch wide polypropylene webbing, start at the end where the ⅞ inch wide grosgrain ribbon aligns with the end of the 9 inch long 1 inch wide polypropylene webbing. Machine stitch all 4 sides of the Velcro® with attached ⅞ inch grosgrain ribbon to the 9 inch long 1 inch wide polypropylene webbing. When stitching across the short width of the Velcro®, stitch till ½ inch to the end of Velcro® leaving ½ inch flap of Velcro®.

9. Measure and mark from raw edge of webbing 4 inches. That mark will be the center point to attach paper fastener number holder.

10. Turn webbing over and attached paper fastener number holder by placing the paper fastener number holder slot centered on the 4 inch mark on the right side of the 9 inch long polypropylene webbing, Velcro® face down.

11. Zig zag stitch the paper fastener number holder slot directly onto the 9 inch long 1 inch wide polypropylene webbing at the 4 inch mark, marked off in step 9. The paper fastener number holder slot is stitched on 3 sides securing so that paper fastener number holder slot cannot move.

12. Machine stitch the lose end of the grosgrain ribbon to reverse side of the 9 inch long ⅞ inch wide polypropylene on all 4 sides, stitching over the paper fastener number holder. Stitch only until were the Velcro® is stitched on the other side, about 1 inch from the webbing's end.

13. At the raw end of the 9 inch long ⅞ inch wide polypropylene webbing, fold the grosgrain ribbon over the end covering the webbing. Stitch down to where the Velcro® and the grosgrain ribbon meet. Continue to stitch across so that ribbon is now secure to the webbing creating a stitched box. Velcro® not stitched in.

14. Fold grosgrain ribbon from the Velcro® fold, to the webbing edge and back to Velcro® fold, over the box just stitched in step 13 making a loop. Cut off extra piece of ribbon beyond Velcro® fold.

15. Fold the grosgrain ribbon towards itself and make a loop.

16. Fold the grosgrain ribbon loop towards the flat stitched box.

17. Pull Velcro® flap up and push folded ribbon under the Velcro®. Zig Zag stitch across to fasten the ribbon folds under the Velcro® creating a slot.

18. Insert belting elastic into the slot created in step 14 and stitch the slot closed with belting elastic sandwiched in between. Stitch around the open raw edges on 4 sides in a "box" to secure elastic to armband.

19. Insert covered webbing end in to the slide to complete circle shape of armband.

20. Fold end over the slide about ½ inch towards the inside (non-Velcro® side) and stitch in "x-box" stitch.

Figure 23:
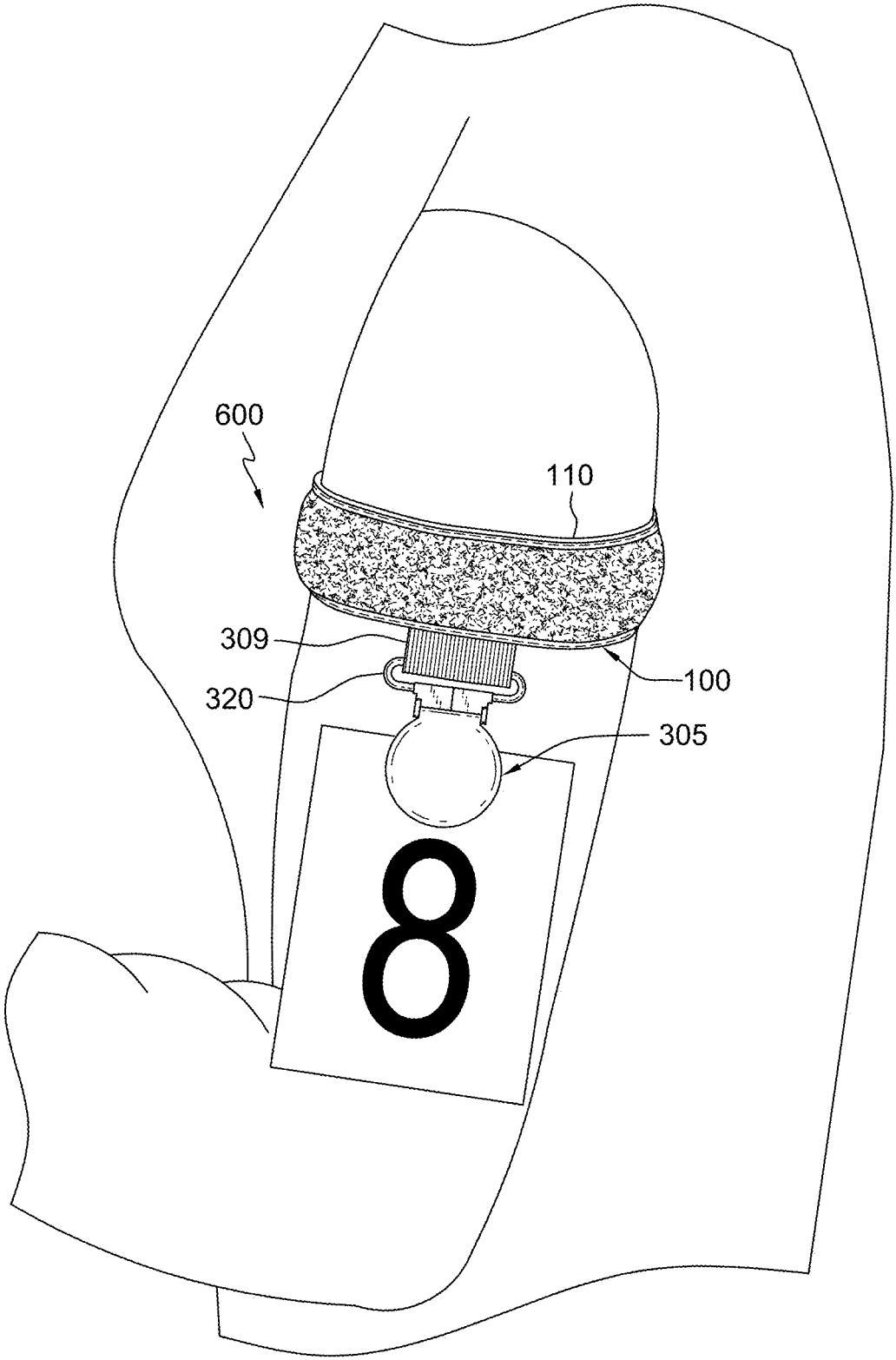
FIG. 23 is a perspective view of a decorative band system according to an embodiment of the present disclosure worn on an arm of a person with an identification card disposed vertically below the decorative band system and with decorative ornamentation disposed along the longitudinal length of the decorative band system.

FIG. 23 illustrates a decorative band system 600 according to an embodiment of the present disclosure without decorative ornamentation. Decorative band system 600 is essentially the same as decorative band system 10 with the exception of the attachment of a second connector 305 to elongated band 100. In this embodiment, second connector 305 may be secured to elongated band 100 using a web or fabric member 309 such as a piece of 1 inch wide by 2 inch long piece of grosgrain ribbon and 1 inch×1 inch piece of polypropylene webbing that is secured to the second connector such as passing through loop 320, and which in turn is then sewn onto fabric strip 110, e.g., along the inner surface of fabric strip 110.

Figure 24:
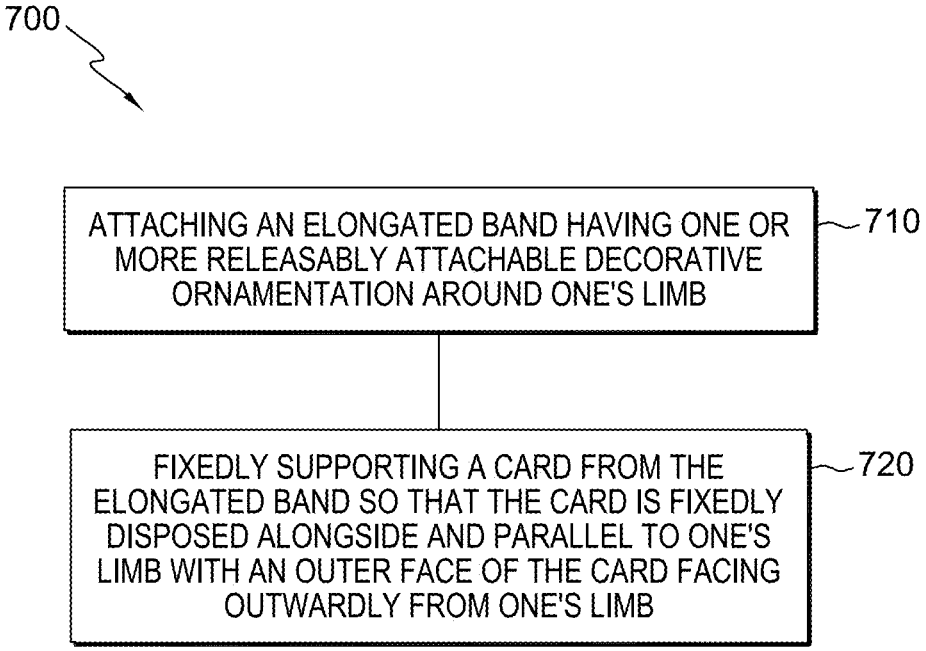
FIG. 24 is a method according to an embodiment of the present disclosure.

FIG. 24 illustrates a method 700 according to an embodiment of the present disclosure. In this exemplary embodiment, method 700 includes at 710 attaching an elongated band having one or more releasably attachable decorative ornamentation around one's limb, and at 720 fixedly supporting a card from the elongated band so that the card is fixedly disposed alongside and parallel to one's limb with an outer face of the card facing outwardly from one's limb.

From the present description, it will be appreciated that the decorative band system may include some form of attach-and-release, or removable attachment, means or mechanism for attaching at least one decorative ornamentation. The attachment mechanism may be affixed to a fabric strap using known methods (sewn, stitched, glues, and the like). In some preferred embodiments, a removable attachment mechanism may include a hook and loop fastening system (or hook and loop fasteners), commonly referred to as Velcro®, though such is not considered limiting and other removable attachment means such as snaps, button/buttonholes, etc. can also be used and are considered within the scope of the present disclosure.

In certain embodiments, the hook and loop fastening system may be about ¾ inches (about 1.9 cm) wide by about 6 inches long (about 15.2 cm), but one of ordinary skill will recognize that the width and length of hook and loop fastening system can be longer or shorter depending on the size required for any particular user, and depending on the width and length of fabric strap.

The decorative ornamentation may take form as fixed ornamentation on the fastening means itself, or as pendants or other dangling ornament (not shown). The decorative ornamentation may provide different designs or shapes that can be interchangeably be used in connection with the decorative band systems while still allowing decorative band systems to perform the intended functionality. For example, ornaments may comprise different dog breed pins, which are interchangeable depending on the dog being shown by the user. Such dog breeding pins are known in the art and conventionally used by dog owners.

Alternate embodiments may include different shapes, sizes and colors of bows, ribbons, crystals, beads, jewelry, and pins, and may include reflective material or otherwise have reflective strips or reflective elements, light emitting diode (LED), or some other form of light emitting source.

It will be appreciated that the present disclosure provides, in some embodiments, adjustable armbands with different interchangeable decorative ornamentation or covers. The present disclosure may provide a simple and elegant with a ribbon cover (e.g., in a rainbow of colors to select from), or maybe a fancy bling cover. The covers are desirably interchangeable with the interchangeable armband.

The armbands may be adjustable with and elastic and slide adjuster and come in sizes extra small, small, medium, large, and extra-large. Custom sizes may be provided.

A user can match one's suit or outfit, match one's dog's colors, club colors, the possibilities are endless. A portrait pin or a commemorative pin may be added. The pins may be available by custom order and are interchangeable on the ribbon and bling covers. Custom jewelry orders may be suitably provided, e.g., where a user supplies the jewelry.

To install a cover, align the center of the interchangeable cover with the armband clip. Press on to Velcro® at the center and work outward on both sides until cover is on secure.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising", when used in this specification, specify the presence of stated features, integers, steps, operations, elements, and/or components, but do not preclude the presence or addition of one or more other features, integers, steps, operations, elements, components and/or groups thereof.

The corresponding structures, materials, acts, and equivalents of all means or step plus function elements in the descriptions below, if any, are intended to include any structure, material, or act for performing the function in combination with other elements as specifically noted. The description of the technique has been presented for purposes of illustration and description, but is not intended to be exhaustive or limited to the invention in the form disclosed. Many modifications and variations will be apparent to those of ordinary skill in the art without departing from the scope and spirit of the invention. The embodiment was chosen and described in order to best explain the principles of the invention and the practical application, and to enable others of ordinary skill in the art to understand the invention for various embodiments with various modifications as are suited to the particular use contemplated.

Although the preferred embodiments of the present invention have been described herein, the above description is merely illustrative. Further modification of the invention herein disclosed will occur to those skilled in the respective arts and all such modifications are deemed to be within the scope of the invention as defined by the appended claims. In other words, this invention is subject to many different forms and shapes and the preferred method shown illustrations have certain details with the understanding that the present disclosure should be considered as an example of the basic principles of the invention and it is not intended to limit variations of the device, system and/or method to other sizes, configurations and materials.

For example, all locations, sizes, shapes, proportions, measurements, amounts, angles, component locations, part locations, fasteners, configurations, weights, dimensions, values, percentages, materials and/or orientations discussed above or shown in the drawings are merely by way of example and are not considered limiting and other locations, sizes, shapes, proportions, measurements, amounts, angles, component locations, part locations, fasteners, configurations, weights, dimensions, values, percentages, materials and/or orientations can be chosen and used and all are considered within the scope of the invention.

Dimensions of certain parts as shown in the drawings may have been modified and/or exaggerated for the purpose of clarity of illustration and are not considered limiting.

Unless feature(s), part(s), component(s), characteristic(s) or function(s) described in the specification or shown in the drawings for a claim element, claim step or claim term specifically appear in the claim with the claim element, claim step or claim term, then the inventor does not considered such feature(s), part(s), component(s), characteristic(s) or function(s) to be included for the claim element, claim step or claim term in the claim for examination purposes and when and if the claim element, claim step or claim term is interpreted or construed. Similarly, with respect to any "means for" elements in the claims, the inventor considers such language to require only the minimal amount of features, components, steps, or parts from the specification to achieve the function of the "means for" language and not all of the features, components, steps or parts describe in the specification that are related to the function of the "means for" language.

While the invention has been described and disclosed in certain terms and has disclosed certain embodiments or modifications, persons skilled in the art who have acquainted themselves with the invention, will appreciate that it is not necessarily limited by such terms, nor to the specific embodiments and modification disclosed herein. Thus, a wide variety of alternatives, suggested by the teachings herein, can be practiced without departing from the spirit of the invention, and rights to such alternatives are particularly reserved and considered within the scope of the invention.

The invention claimed is:

1. A decorative band system to be worn around a limb of a user for supporting a card, said system comprising:

an elongated band sized to be disposable and retainable around the limb of the user, said elongated band having an inner surface disposable towards the limb of the user and an outer surface disposable facing away from the limb of the user;

a first connector attached to said outer surface of said elongated band between an upper longitudinal edge and a lower longitudinal edge of said elongated band;

a releasably attachable elongated decorative cover having a decorative front side and a rear side having a connector releasably attachable to said first connector, said releasably attachable elongated decorative cover having a width extending between said upper longitudinal edge and said lower longitudinal edge of said elongated band and having a length extending continuously along observable portions of the elongated band disposable around the limb of the user;

a second connector attached to said elongated band, said second connector having a first leg and a second leg disposed and defining a clamp below said lower longitudinal edge of said elongated band, said legs releasably connectable to the card so that the card is spaced apart from said elongated band; and wherein said elongated band and said second connector are configured so that when said system is worn on the limb of the user and connected to the card, the card is maintainable in a fixed relationship alongside and parallel to the limb of the user.

2. The system of claim 1 further comprising a second releasably attachable elongated decorative cover interchangeable with the releasably attachable elongated decorative cover, said second releasably attachable elongated decorative cover having a decorative front side and a rear side having a connector releasably attachable to said first connector, said releasably attachable elongated decorative cover having a length extending continuously along observable portions of the elongated band disposable around the limb of the user, and wherein said front side of said second releasably attachable elongated decorative cover being different from said front side of said first releasably attachable elongated decorative cover.

3. The system of claim 1 wherein said releasably attachable elongated decorative cover comprises said front side comprising a plurality of crystal ornaments.

4. The system of claim 1 wherein said releasably attachable elongated decorative cover comprises said front side comprising a ribbon.

5. The system of claim 1 wherein said second connector is fixedly attached to said inner surface of said elongated band.

6. The system of claim 1 wherein said legs in a clamping orientation comprises a planar first side and a generally parallel planar second side, at least one of said planar first side and said planar second side being positionable towards the limb of the user while said other of said planar first side and said planar second side facing away from the limb of the user.

7. The system of claim 1 wherein said first connector comprises a hook portion or a loop portion of a hook-and-loop fastener.

8. The system of claim 1 wherein said elongated band is adjustable.

9. The system of claim 8 wherein said elongated band comprises a fabric member and an elastic member.

10. The system of claim 9 wherein said elongated band comprises at least one slider for adjusting the length of said elastic member.

11. The system of claim 9 wherein said elastic member comprises a first width and said fabric member comprises a second width greater than said first width.

12. The system of claim 1 wherein said elongated band comprises a continuous loop disposable around the limb of the user.

13. The system of claim 1 wherein said elongated band comprises a circumference of about 8 inches to about 14 inches long (about 20.3 cm to about 35.5 cm).

14. A method comprising:

attaching the decorative band system of claim 1 around one's limb; and supporting a card by the second connector so that the card is fixed in position relative to the elongated band, and fixed alongside and parallel to the limb of the user with an outer face of the card facing outwardly from the limb of the user.

15. The method of claim 14 wherein the supporting comprises supporting the card so that the card is fixed in a vertical position above the elongated band, and fixed alongside and parallel to the limb of the user.

16. The method of claim 14 wherein the supporting comprises supporting the card so that the card is fixed in a vertical position below the elongated band, and fixed alongside and parallel to the limb of the user.

17. The wearable decorative band system of claim 1 wherein said first leg comprises teeth and said second leg comprises teeth.

18. The wearable decorative band system of claim 1 wherein said first leg comprise a fixed leg relative to said elongated band and said second leg comprises a movable leg.

19. A wearable decorative band system comprising:

an elongated band having an inner surface, an outer surface, an upper longitudinal edge, a lower longitudinal edge;

a first connector attached to said outer surface of said elongated band between said upper longitudinal edge and said lower longitudinal edge of said elongated band;

a releasably attachable elongated decorative cover having a decorative front side and a rear side having a connector releasably attachable to said first connector, said releasably attachable elongated decorative cover extending between said upper longitudinal edge and said lower longitudinal edge and substantially around said outer surface of said elongated band; and a second connector attached to said elongated band, said second connector having a first leg and a second leg defining a clamp spaced downwardly from said lower longitudinal edge of said elongated band.

20. The wearable decorative band system of claim 19 further comprising a decorative element attached to said second connector.

21. The wearable decorative band system of claim 19 wherein said releasably attachable elongated decorative cover comprises a decorative element vertically aligned with said second connector.

22. The wearable decorative band system of claim 19 wherein said releasably attachable elongated decorative cover comprises an elongated bow having loops extending the length of said releasably attachable elongated decorative cover, a plurality of crystals, a pin, or a combination thereof.

23. The wearable decorative band system of claim 19 wherein said elongated decorative front side comprises an elongated bow having loops extending continuously from one end to the other end of the length of said elongated decorative front side and a crystal ornament disposed in a center portion of said decorative front side.

24. The wearable decorative band system of claim 19 wherein said elongated decorative front side comprises said elongated arrangement of a plurality of crystals extending substantially continuously from one end to the other end of the length of said elongated decorative front side.

25. The wearable decorative band system of claim 19, further comprising a second interchangeable releasably attachable elongated decorative cover comprising:

an elongated decorative front side;

an elongated rear side;

said elongated decorative front side and said elongated rear side comprising a length greater than a width;

a connector for releasably attaching said rear side to the wearable band; and wherein said elongated decorative front side of said second interchangeable releasably attachable elongated decorative cover being different from said elongated decorative front side of said first interchangeable releasably attachable elongated decorative cover.

26. The wearable decorative band system of claim 19 wherein said first leg comprises teeth and said second leg comprises teeth.

27. The wearable decorative band system of claim 19 wherein said first leg comprise a fixed leg relative to said elongated band and said second leg comprises a movable leg.

* * * * *